United States Patent [19]

Camarota

[11] Patent Number: 4,976,212

[45] Date of Patent: Dec. 11, 1990

[54] PORTLIGHT FOR WATER CRAFT

[75] Inventor: Richard J. Camarota, Holland, Mich.

[73] Assignee: ITC Incorporated, Zeeland, Mich.

[21] Appl. No.: 343,524

[22] Filed: Apr. 26, 1989

[51] Int. Cl.[5] ..... B63B 19/00

[52] U.S. Cl. ..... 114/178; 49/171; 296/224

[58] Field of Search ..... 114/173–178, 114/211; 49/171, 402, 479, 485, 489; 244/129.3; 296/224, 146; 292/27, 65, 83, 111, 197, 240, 257

[56] References Cited

U.S. PATENT DOCUMENTS 4,095,640 6/1978 Beckerer, Jr. ..... 114/178

FOREIGN PATENT DOCUMENTS 162126 4/1921 United Kingdom ..... 114/178
652722 5/1951 United Kingdom ..... 114/177

*Primary Examiner*—Sherman Basinger

*Assistant Examiner*—Jesüs D. Sotelo

*Attorney, Agent, or Firm*—Flynn, Thiel, Boutell & Tanis

[57] ABSTRACT

A portlight for installing at an opening in a wall of a boat, comprising an interior frame surrounding an open viewing area. The interior frame comprises an axially extending spigot for outward insertion in an opening in a wall of a boat and an interior flange extending radially outward from the spigot to overlap the interior face of the wall of the boat. An exterior frame surrounds an open viewing area. Plural fasteners fixedly clamp, between the interior flange and exterior flange, the rim of the opening in the wall of the boat. A pair of widely-spaced holes through the interior flange receive screw means for biting into the adjacent wall of the boat and thereby temporarily fix the interior flange on the wall of the boat to allow a single installer to place the exterior flange and install the plural fastener means and thereby clamp the exterior flange and interior flange on the rim of the opening in the wall of the boat.

12 Claims, 2 Drawing Sheets

PORTLIGHT FOR WATER CRAFT

FIELD OF THE INVENTION

This invention relates to a portlight for installing at an opening in a wall of a boat.

The objects and purposes of the invention include provision of a portlight which is installable by a single installer without assistance, in which fixed and openable portlights can have the same exterior appearance to allow intermingling of both types on the same wall of a boat without visual conflict, in which the hinges and latches on an openable portlight do not protrude into the viewing area of the portlight, in which the lens of an opening portlight is held closed in an even manner about its entire circumference, in which an opening lens can be cut from light transmitting sheet material rather than having to be formed by molding, and which can be produced at low cost and readily installed by relatively unskilled persons.

Other objects and purposes of the invention will be apparent to persons acquainted with apparatus of this general type upon reading the following description and inspecting the accompanying drawings.

BACKGROUND OF THE INVENTION

A variety of types of portlights, both openable and non-openable, have been available for installation on cabin and hull walls of boats for many years to provide natural light and, in the case of openable portlights, ventilation.

Bronze-framed fixed and opening ports, using glass lenses, have long been known but are very expensive and are not readily constructible in the sleek, oblong shapes which go well with modern Fiberglass boat designs.

Fixed portlights consisting merely of a sheet of Plexiglas TM screwed over a bead of sealant to the exterior of a boat cabin wall cover a light-admitting opening are inexpensive to make and install but tend to have a rather unfinished-looking appearance, are set out at least by the thickness of the lens from the outside surface of the cabin wall, and are not openable.

In the last few decades, a number of openable portlights, using lenses and/or frames of rigid, molded plastics material, have been available. Those of which I am aware have, in my opinion, been less than entirely satisfactory. Typical problems involve protrusion of the hinges or closed latches into the viewing area of the port or into the living space of the cabin to a sufficient extent to bruise persons moving in the cabin. In at least some instances, these prior portlights have been relatively expensive because of the need for molding of the lens to incorporate hinge structure. Installation has often been time consuming and required two people (one person inside the boat and another outside). At least in some units, interior and exterior portlight frames must be separately affixed, as by screws, to the adjacent wall of the boat, which takes additional installation time and thus creates additional installation cost.

The present invention arises from an attempt to overcome these and a variety of other drawbacks in existing portlights.

SUMMARY OF THE INVENTION

Figure 1:
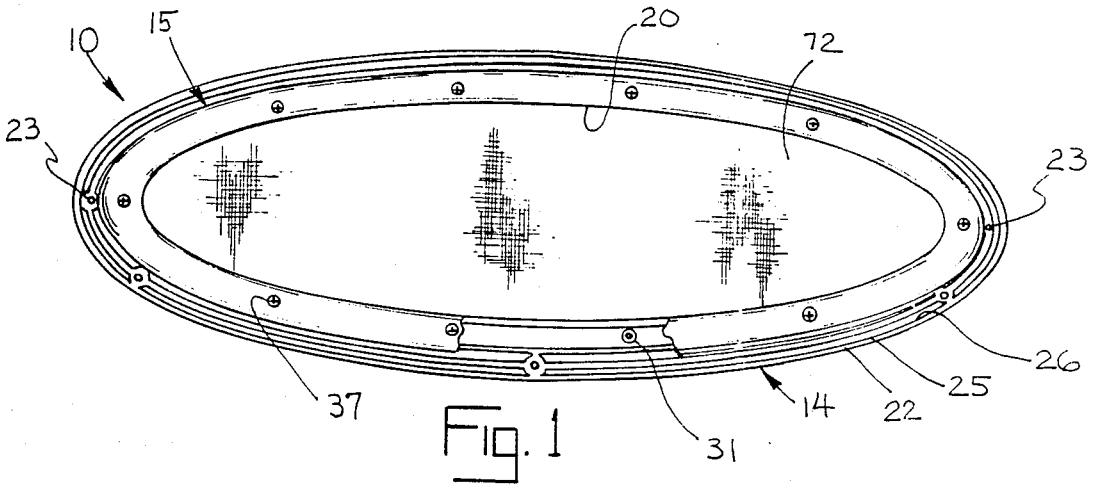
FIG. 1 is a partially broken exterior elevational view of a portlight embodying the invention.

A portlight for installing at an opening in a wall of a boat comprises a frame surrounding an open viewing area, means for fixing the frame in an opening of the wall of the boat and a light-transmitting lens supported by the frame.

DETAILED DESCRIPTION

A portlight 10 (FIGS. 1 and 2) embodying the invention is installable in an opening (an edge of which is shown at 11 in FIGS. 5 and 7) in the wall 12 (typically the generally upstanding wall of the hull or cabin, of a boat (not shown). The portlight 10 comprises an interior frame 14 and an exterior frame 15 to be installed respectively on the interior face 16 and exterior face 17 (FIG. 5) of the wall 12 of the boat at the opening 11, for clamping the wall 12 therebetween at the rim of the opening 11.

Figure 2:
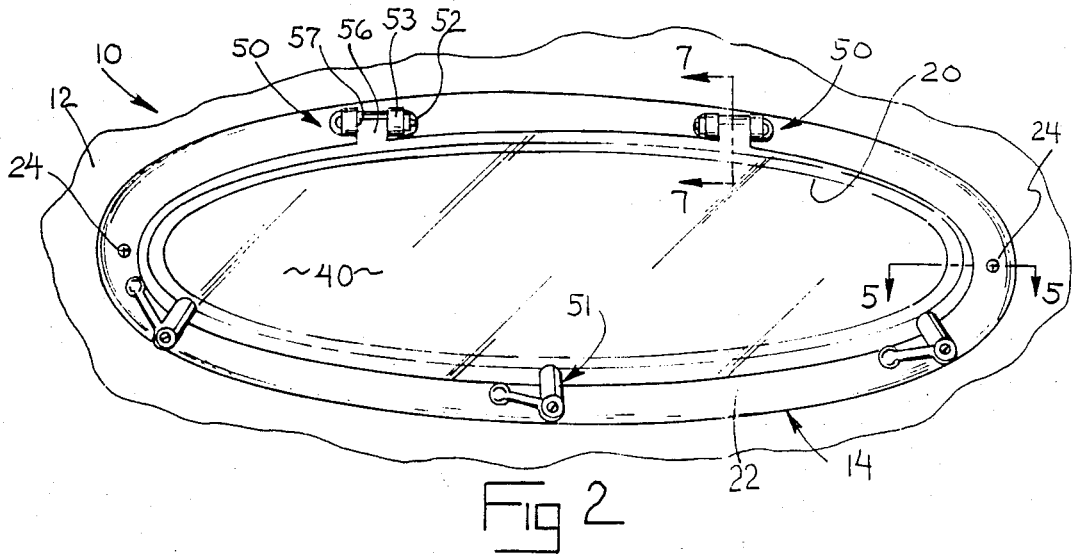
FIG. 2 is an interior elevational view of the portlight of FIG. 1.

In the embodiment shown, the interior and exterior frames 14 and 15, and hence the portlight 10 as a whole is of elongate oval shape as seen in FIGS. 1 and 2. However, the invention contemplates portlights of other shapes and sizes, within its broader confines.

The interior frame 14 is an endless loop-shaped member surrounding an open viewing area 20 (FIGS. 1, 2 and 5) slightly smaller than the opening 11 in the boat wall 12 and conforming generally thereto in shape. The interior frame 14 comprises an axially extending spigot 21 (FIG. 5) for outward insertion in the opening 11 in the boat wall 12, and a generally planar interior flange 22 extending radially outward from the spigot 21 to overlap the interior face 16 of the boat wall 12.

A pair of holes 23 (FIGS.1, 2 and 5) extend through the interior flange 22 at opposite ends of the interior frame. The holes 23 oppose the interior face 16 of the boat wall 12. A corresponding pair of short screws 24 are insertable in the holes 23 outboard of the rim of the opening 11 for threading part way through the thickness of the boat wall 12. The screws 24 temporarily hold the interior frame 14 fixedly and snugly against the interior face 16 of the boat wall 12, to enable installation of the portlight 10 by the single installer, i.e., to hold the interior frame in place in the opening 11 in the boat wall 12, while the installer goes outside the boat to install the exterior frame 15 and thereby complete installation of the portlight 10 on the boat. For improved appearance and to keep the interior face of the interior flange 14 smooth, the screws 24 are of flathead type and the hole 23 is countersunk to receive same, in the manner shown in FIG. 5.

The interior flange 22 has a face 25 (FIG. 5) which is held in abutting contact with the interior face of the boat wall 12 by the screws 24. Circumferential grooves 26 in the face 25 oppose the interior face 16 of the wall 12. A suitable marine sealant, not shown, is normally applied to the face 25 prior to its securement against the wall 12 by the screws 24 and fills the grooves 26, so as to produce a circumferentially continuous seal between the internal flange 22 and the interior face 16 of the boat wall 12.

Figure 7:
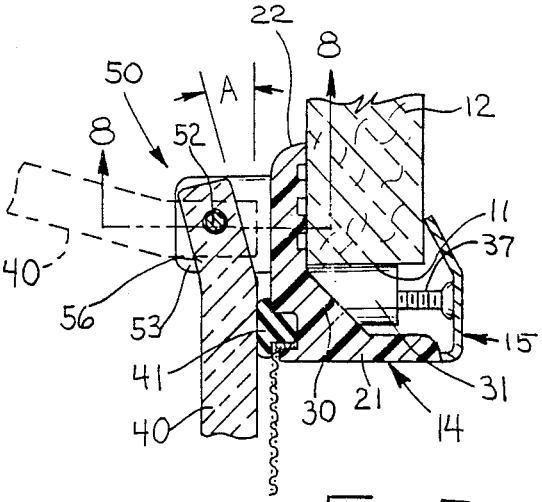
FIG. 7 is an enlarged fragmentary sectional view taken on the line 7—7 of FIG. 2.

In cross section, as seen in FIG. 7, the spigot 21 and interior flange 22 extend at substantially right angles to each other. In the angle, between the spigot 21 and interior frame 22, is molded in place a wedge-shaped bracing portion 30 which extends continuously circumferentially around the interior frame 14 and strengthens the connection of the spigot 21 and interior flange 22.

Figure 5:
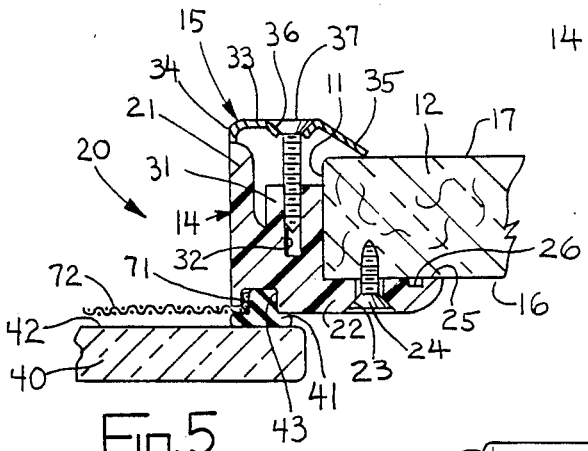
FIG. 5 is an enlarged fragmentary sectional view substantially taken on the line 5—5 of FIG. 2.

A plurality of generally cylindrical bosses 31 are circumferentially distributed around the interior frame 14 and are molded integrally therein. The bosses 31 extend axially outward from the wedge-shaped bracing portion 30 in close spaced parallel relation to the spigot 21 and radially outboard thereof. The spigot 21, however, extends axially beyond the outer ends of the bosses 31. The opening 11 in the wall 12 of the boat is preferably sized to fit snugly around the circumferential array of bosses 31, as illustrated in FIGS. 5 and 7. It will be seen that the bracing portion 30 also helps brace the bosses 31 by partially overlapping same.

The bosses 31 each have concentric, outwardly opening elongate holes 32 (FIG. 5) therein.

The exterior frame 15, in the embodiment shown, is a metal (preferably stainless steel), circumferentially closed member, of the same oval shape as the interior frame 14. As seen in FIG. 5, the exterior frame 15 in cross section comprises a radially extending central portion 33, a short interiorly bent, radially inner flange 34, and an interiorly and radially outwardly sloped radially outer flange 35.

Countersunk holes 36 through the central portion 33 of the exterior frame coaxially align with the holes 32 in the bosses 31. Screws 37 extending interiorwise through the holes 36 in the exterior frame 15 are threaded into the holes 32 in the bosses 31. When tightened firmly, the screws 37 interiorly push the radial flange 34 against the exterior end of the spigot 21 and push the remote edge of the sloped flange 35 against the exterior face 17 of the boat wall 11. In this way, tightening of the screws 31 snugly sandwiches the boat wall 12 between the free end of the sloped flange 35 of the exterior frame 15 and the interior flange 22 of the interior frame 14. Such holds the assembled interior and exterior frames rigidly in place to frame the opening 11 in the boat wall 12. The pressure of the interior flange 22 against the interior face 16 of the wall 12, caused by the tightening of the screws 37, presses the sealant material (not shown) lying between the interior flange 22 and interior surface 16 of the wall 12 to assure a water tight seal between.

Once the screws 37 are all tightened, the initial pair of locating screws 24 are no longer needed. However, same will normally be left in place as shown in FIGS. 2 and 5.

The open viewing area defined within the frames 14 and 15 is, in the embodiment shown, closable, against wind and water, by a lens 40 of suitably transmitting rigid sheet material. In the preferred embodiment shown, the lens 40 is of a clear (tinted or untinted) rigid plastics material, preferably black Plexiglas TM. In its closed position shown in solid lines in the drawings, for example in FIG. 5, the peripheral edge portion of the exterior face 42 of the lens 40 bears sealingly against a generally T cross section, resilient seal ring 41 which is snugly received in a groove 43, here of generally square cross section, which faces interiorly of and is provided in the interior face of the interior flange 22 of the interior frame 14. More particularly, the groove 43 is located adjacent the radially inner (left in FIG. 5) edge of the interior frame 14 at the joinder of the spigot 21 and interior flange 22 thereof. The head of the T cross section seal 41 protrudes interiorly beyond and thus somewhat overlies the interior surface of the interior flange 22 whereas the leg of such T cross section seal member 41 is housed in the circumferential groove 43 and retained therein by any convenient means such as adhesive bonding not shown.

The annular seal 41 extends the entire circumferential extent of the interior frame 14. The lens 40 in its closed position shown in solid lines in the drawings is adapted to bear circumferentially continuously against the seal 41 to prevent entry of wind and water into the cabin of the boat.

The lens 40 is maintained in its closed, sealed position shown in solid lines in the drawings by means of a pair of hinges 50 (FIGS. 2, 7 and 8), and several (here three) closure members 51 (FIGS. 2, 3, 4 and 6). In the preferred embodiment shown, two hinges 50 and three closure members 51 are substantially evenly circumferentially distributed about the interior frame 14 in a symmetrical manner, namely with the hinges 50 on one side of the elongate oblong defining the interior frame, and with the three closure members 51 on the opposite side of the oval interior frame. Thus, the hinges 50 each transversely oppose a space between an adjacent pair of closure members 51 and the middle closure member 51 faces a space between the two hinges 50. The circumferential spacing between each hinge 50 and its adjacent closure member 51 is approximately equal to the circumferential space between adjacent hinges 50 and adjacent closure members 51. In this way, the stress of maintaining the lens in its closed, sealed condition is applied with substantial circumferentially evenness.

The present inventor has found that, aside from its strength and low cost of manufacture, the cutting of the peripheral shape of the lens from a larger sheet of Plexiglas TM can readily take place.

Figure 8:
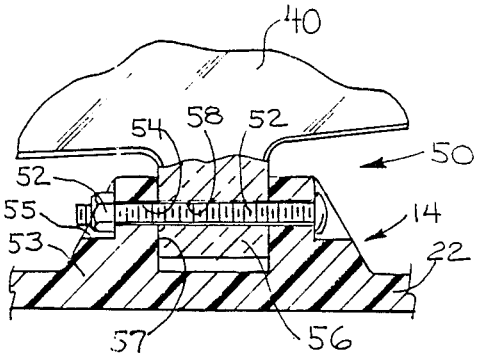
FIG. 8 is a fragmentary sectional view substantially taken on the line 8—8 of FIG. 7 with the lens in a partially open condition.

The hinges 50 (FIG. 2) have coaxial pivot axes defined by coaxially aligned bolts 52 (FIGS. 2, 7 and 8). Each hinge 50 further comprises a pair of ears molded into and upstanding from the interior space 53 of the interior flange 22 of the interior frame 14. The hinge axis bolt 52 extends through coaxial holes 54 (FIG. 8) in the ears 53 of the corresponding hinge. Triangular cross section reliefs 55 in the oppositely facing ends of the ears 53 of a given hinge provide a seat for the head and nut of each hinge axis bolt 52.

The sheet material defining the lens 40 is cut along its periphery to define a panel with two integral tabs 56 extending from the oval periphery of the lens panel along one edge thereof (the upper edge in FIG. 2). Each tab 56 extends into the gap 57 between a corresponding pair of ears 53. Each tab 56 is bent upwardly through an acute angle A (FIG. 7) of about 10° to 20° so as to be centered on the axis of the hinge bolt 52. A hole 58 laterally through the central portion of the tab 56 receives the central portion of the hinge bolt 52 snugly therethrough. The tab 56 is disposed snugly between the ears 53.

By tightening the nut 52' on the hinge bolt 52 the hinge ears 53 can be pulled more tightly into contact with the sides of the tab 56 to increasingly frictionally resist pivoting of the lens with respect to the interior frame. The nut 52' is preferably adjusted so that this frictional resistance is sufficient to support the weight of the lens 40 in an open position, such as the open position at dotted lines in FIG. 7, but yet to allow pivoting of the lens 40 from its closed position, so in its solid lines in the drawings through a range of open positions extending up to a fully open one (not shown) in which the lens 40 is swung approximately 180° up from its solid line position in FIG. 7. The hinge bolt 52 is preferably threaded only at the end engaged by the nut 52' to minimize the wear by the hinge bolt on the surfaces of the ears 53 and tab 56 resulting from repeated opening and closing of the lens 40. The nut 52' on the hinge bolt 52 is preferably a self-locking nut, of the usual kind having a high degree of friction, so that it will not tend to loosen by itself during repeated opening and closings of the lens 40.

The closure members 51 each comprise a generally L-shaped crank member 60 (FIGS. 2–4) having a handle leg 61 and a latch leg 62 joined at less than a 90° angle, here about 70° to 80°. The closure member 51 is pivoted at the joinder 63 of the legs (FIG. 3) on a pivot axis substantially perpendicular to the plane of the interior frame 14 and the common plane of the legs 61 and 62. The pivot axis is defined by a pivot screw 64. In the embodiment shown, the pivot screw 64 is flat headed and countersunk in a hole 65 in the leg joinder 63. The screw is threaded down through a stepped, circular cross section boss 66 (FIG. 6) integrally molded in the interior surface of the interior frame 14. The boss 66 extends somewhat above the level of the seal 41 so as to partially overlap the edge of the lens 40 with the lens 40 in its closed position of FIG. 6. The boss 66 is disposed near to but is spaced somewhat from the adjacent edge of the lens 40. In this way, the L-shaped crank member 60 is mounted for pivotal movement on the interior face of the interior frame 14.

The handle leg 61 in plan (FIG. 3) has a slightly enlarged, rounded free end 67 to help prevent the finger of the user from sliding off the handle leg 61 during latching or unlatching of the closure member 51. The free end portion 67 (FIG. 6) also has a depending skirt 68 which interferes with the edge of the closed lens 40 so as to limit pivoting movement of the closure member 51 and thus, by feel, enables the user to know when the closure member 51 is in its fully open (FIG. 3) or fully closed (FIG. 4) position easily and without need for visual feedback (for example in the dark).

Figure 9:
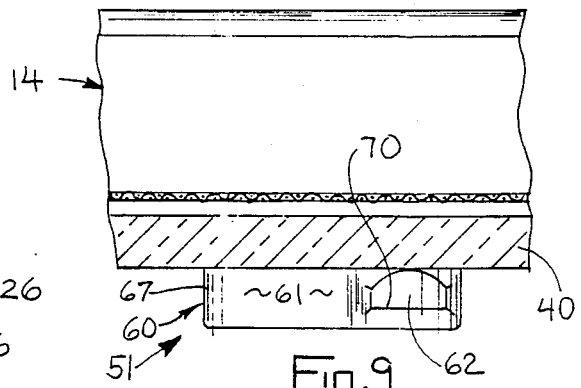
FIG. 9 is a fragmentary sectional view substantially taken on the line, 9—9 of FIG. 4.
Figure 6:
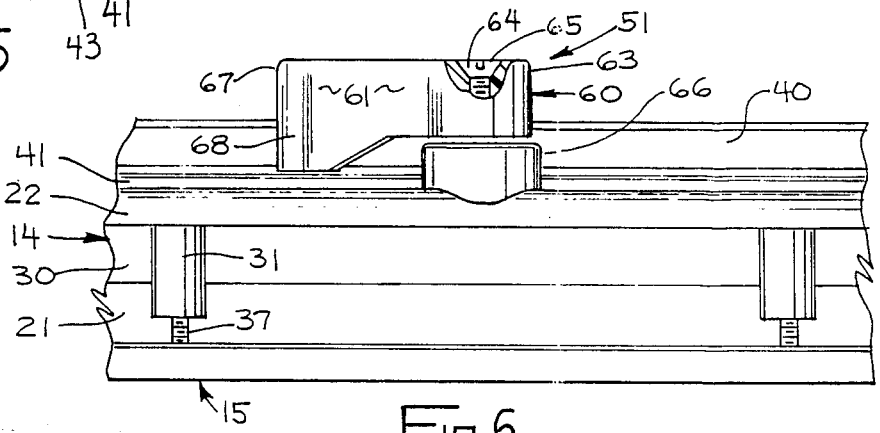
FIG. 6 is a fragmentary edge view of the FIG. 4 apparatus, substantially taken on the line 6—6 of FIG. 4.

The latch leg 62 is shorter and substantially less thick than the handle leg 61. The latch leg 62 is at a height above the interior face of the interior frame 14 such that when pivoted into overlapping relation with the interior face of the closed lens 40, it firmly clamps the lens 40 against the seal 41 to effect a closed locked condition of the lens, such that wind and spray are prevented from entering the cabin of the boat through the portlight. The exterior face of the latch leg is semi-circularly convex as shown at 70 in FIG. 9, forming a cam-like undersurface to enable the latch legs 62 to be easily swung over the edge of the closed lens 40 and then progressively exert force on the surface of the lens 40 to press it snugly against the seal 41. The handle leg 61 is at least about two-thirds longer than the latch leg 62 to provide a mechanical advantage in pivoting the latch leg onto and off of the closed lens 40.

The placement of the camming surface 70 and mentioned location of the hinge bolts 52 and tabs 56 are such that the entire perimeter portion of the exterior face of the lens 40 is pressed snugly and sealingly against the entire opposed circumferential seal 41.

Figure 4:
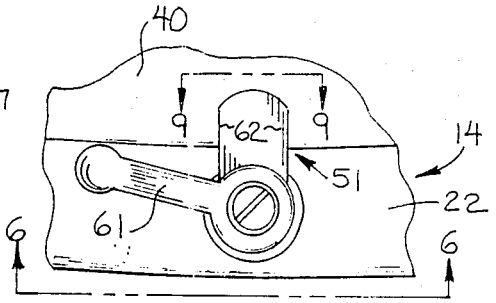
FIG. 4 is a view similar to FIG. 3 but with the closure member in its fully closed position for locking the movable lens closed.

The length of the latch leg 62 is such that in its closed position shown in FIGS. 2 and 4, it does not intrude into the vision area of the closed lens 40, nor does the structure of the hinge 50 so intrude.

In the preferred embodiment shown, a sheet of conventional insect screen 72 extends in a planar manner across the open viewing area 20 (FIG. 5), overlaps the inner peripheral portion of the interior face of the interior flange 22 and is bent into the circumferential groove 43 therein. The annular seal 41 traps the peripheral edge 71 of the insect screen 72 in the groove 43, tending to apply a tensile force to the screen to maintain it planar. The annular seal 41 can be held fixed in the groove 43 and hence can maintain the peripheral edge portion 71 of the screen trapped therein, by a variety of alternative means, such as a conventional adhesive, an undercut configuration (not shown) of the groove 43, or other conventional means.

Although the foregoing description has been in terms of an openable portlight, it will be understood that many of the same features above described can be applied to a fixed portlight. Such a fixed portlight can have exactly the same exterior appearance by use of the same exterior frame 15 and mounting screws 37. A lens, generally similar to the lens 40, can be permanently and sealingly fixed in a conventional manner to an interior frame, similar to interior frame 14. It will be understood that the screen 72, hinges 15, and closure members 51 would not be included in such a fixed portlight.

OPERATION

The operation of the portlight 10 will be apparent from the above description of its structure. However, for convenience, operation will be summarized below.

To install the portlight 10, an opening 11 is cut in the desired position in a wall above the cabin (or the hull above the water line) of the boat. The opening 11 is sized and shaped to snugly receive the spigot 21 and plural bosses 31 (FIG. 5) of the interior frame 14. With a suitable marine sealant applied to the boat engaging face 25 of the interior flange 22 of the interior frame 14, the latter is moved into contact with the interior face 16 of the boat wall 12 adjacent to the opening 11. The two locating screws 24 are inserted through their holes 23 in the opposite ends of the interior flange 22 and are screwed into the interior face 16 of the hull wall 12 to locate the interior flange 14 thereon with sufficient rigidity to enable a single installer to then go outside the boat to install the exterior frame 15 without fear of having the interior frame drop out of the opening 11 in the boat wall 12. With the radially inner and outer edges of the exterior frame 15 contacting the exterior edge of the spigot 21 and the exterior face 17 of the boat wall 12, and thus overlapping the edge of the opening 11, the plural screws 37 are inserted through the corresponding holes in the exterior flange 15 and screwed into the holes 32 in the bosses 31 of the interior frame 14 to complete installation of the portlight 10.

The interior frame is conveniently of a substantially rigid plastics material, such as ABS. The exterior frame is preferably of stainless steel. Although substantially rigid, the portlight 10 can flex slightly over its length to conform to the slight convex longitudinal curvature typically found on pleasure boat hulls and cabin walls.

Figure 3:
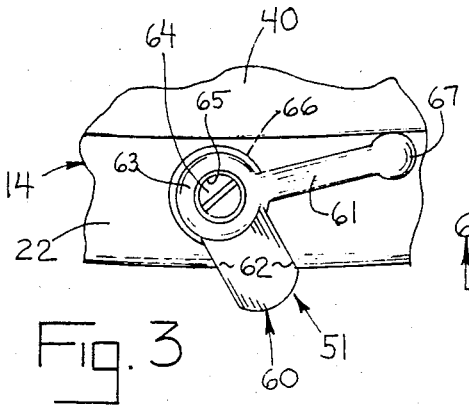
FIG. 3 is an enlarged fragment of FIG. 2 with a closure member (dog) pivoted to a fully open position.

With the portlight thus in place, the lens 40 can be opened by pivoting the closure members 51 counterclockwise from their locking positions as shown in FIGS. 2 and 4 to their open positions as shown in FIG. 3 and such that the latch leg 62 of each closure member 51 no longer overlies the lens 40. The operator can then place his/her finger under the edge of the lens 40 and simply lift it up to a desired open position. Preferably, the nuts 52' are tightened on the hinge bolts 52 to the extent that the lens 40 can be pivoted from its closed position to an open position, but also so that the weight of the lens 40 will not cause the lens 40 to simply drop back into a closed position. Since friction is used to hold the lens 40 open, the lens 40 will tend to stay more readily in a position swung upward 180° from its solid line closed position in FIG. 7 than it would in a position like that shown in the broken line in FIG. 7 where it extends laterally away from the hinges 50. With the portlight fully open, entry of insects into the boat is prevented by the screen 72.

To lock the lens 40 in its closed position shown in solid lines in the drawings, the closure members 51 are pivoted clockwise from their FIG. 3 to their FIG. 4 positions. The rounded convex camming surface 70 on the latch leg 62 allows the latch leg 62 to slide over the edge of the lens 40 and onto the interior surface thereof even if the lens 40 has not been pivoted snugly against the annular seal 41. The camming surface 70 further enables the latch leg 62, as it moves into its final closed position shown in FIG. 4, to wedge the lens 40 into snug sealing contact with the seal 41 around the entire periphery of the lens 40. In this way, the locked-closed lens 40 provides a wind and water tight closure of the opening 11 in the boat wall 12.

Contact of the depending skirt 68 on the free end 67 of the handle leg 61, with the edge of the lens 40, tells the operator by touch that the closure member is either fully locked closed, or is open (FIGS. 4 and 3, respectively) and without need for the operator to actually see the closure member position. This is particularly desirable in permitting operation of the portlight in the dark, e.g., during night cruising or racing where the operator wants to be sure a portlight is securely closed and locked without destroying his night vision.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

I claim:

1. A portlight for installing at an opening in a wall of a boat, comprising:

an interior frame surrounding an open viewing area, said interior frame comprising an axially extending spigot for outward insertion in an opening in a wall of a boat and an interior flange extending radially outward from said spigot to overlap the interior face of the wall of the boat;

an exterior frame surrounding said open viewing area and radially overlapping said spigot and the exterior face of the wall of the boat;

physical obstruction means fixed to and spanning the open viewing area therethrough said interior frame and therewith preventing an installer from reaching through said opening in said wall;

plural fastener means for fixedly clamping, between said interior flange and exterior flange, the rim of the opening in the wall of the boat;

temporary fixing means comprising a pair of holes through said interior flange and widely spaced circumferentially therealong and first screws directed exteriorly through said holes for biting into the adjacent wall of the boat and thereby temporarily fixing said interior flange on the wall of the boat to allow a single installer to install the portlight on a boat;

final fixing means comprising plural circumferentially adjacent through holes in said exterior frame opposing corresponding thread engaging holes in the exterior face of said interior frame and second screws directed interiorly through said holes in said exterior frame and into said opposing thread engaging holes in said interior frame to install said exterior flange and thereby clamp said exterior flange and interior flange on the rim of the opening in the wall of the boat.

2. The apparatus of claim 1 in which said first screws comprises two screws at opposite longitudinal ends of said interior flange.

3. (Amended) The apparatus of claim 1 in which the obstruction means is an insect screen fixed to said interior frame and preventing an installer from reaching through said opening in said wall.

4. The apparatus of claim 1 including a light admitting lens and hinge means for hingedly mounting said lens on said interior frame and closure means actuatable for locking said lens closed on said interior frame in a position adjacent said obstruction means and alternately actuable for allowing hinged opening of said lens for ventilating said boat.

5. A portlight for installing at an opening in a wall of a boat, comprising:

a frame surrounding an open viewing area and having a boat wall oposable face and an exposed face;

means for fixing said frame in the opening in the wall of the boat;

a light admitting lens;

hinge means pivotally mounting one side of said lens on one side of said frame for alternately (1) closing said viewing area against wind and water with said lens and (2) opening said viewing area for ventilation;

closure means actuatable for releasably locking the other side of said lens to the other side of said frame, said lens being a plate of light admitting material of uniform thickness and which is flat at least outside the neighborhood of said hinge means, said closure means comprising a member pivoted on a pivot axis substantially perpendicular to the plane of the frame, said member having a portion remote from said pivot axis and pivotable about said axis, said remote portion including (1) a skirt means pivotable into abutment with the peripheral edge of the lens plate to block further pivoting of the member and thus positively establish a latching position, (2)

a cam means pivotable snugly onto the interior surface of said lens plate as said skirt means approaches said lens plate edge and to positively hold said lens plate closed against said frame, and (3) finger engaging means manually engagable to pivot said member, said skirt means and cam means being angularly offset one from the other about said pivot axis, said skirt means and cam means being respectively close to and farther from the interior surface of said frame.

6. A portlight for installing at an opening in a wall of a boat, comprising:

a frame surrounding an open viewing area and having a boat wall opposable face and an exposed face;

means for fixing said frame in the opening in the wall of the boat;

a light admitting lens;

hinge means pivotally mounting one side of said lens on one side of said frame for alternately (1) closing said viewing area against wind and water with said lens and (2) opening said viewing area for ventilation;

closure means actuatable for releasably locking the other side of said lens to the other side of said frame, said lens comprising a panel cut from uniform thickness sheet material, a given said hinge means comprising a bent-up tab of said sheet material extending from the edge of a substantially larger area of said sheet material sized for covering said viewing area, an ear protruding from said frame adjacent said edge and tab of said panel, means defining aligned passages through said ear and widthwise through said tab, and an elongate fastening element extending through said aligned passages to pivotally mount said tab on said ear and thereby hinge said lens on said frame.

7. The apparatus of claim 6 in which said frame has an elongate oval shape, said hinge means comprising two hinges spaced along said one side of said frame, said closure means comprising three closure members spaced along said other side of said frame, said hinges and closure members all being spaced circumferentially by about the same perimetral spacing, such that each hinge faces transversely across the frame toward a space between two closure members and the central closure member on said other side of said frame faces across said frame toward the space between said hinges, and also such that the clamping forces of the hinges and closure members are evenly circumferentially distributed around said frame.

8. A portlight for installing at an opening in a wall of a boat, comprising:

a frame surrounding an open viewing area and having a boat wall opposable face and an exposed face;

means for fixing said frame in the opening in the wall of the boat;

a light admitting lens;

hinge means pivotally mounting one side of said lens on one side of said frame for alternately (1) closing said viewing area against wind and water with said lens and (2) opening said viewing area for ventilation;

closure means actuatable for releasably locking the other side of said lens to the other side of said frame, a given said closure means comprising a generally L-shaped crank member having a handle leg and a latch leg joined at an angle and pivoted at the joinder of the legs on said frame on a pivot at the joinder of the legs on said frame on a pivot axis substantially perpendicular to the plane of said frame and the common plane of said legs, said handle leg having a free end portion spaced close to said frame for colliding with the rim of said lens, with said lens in its closed position, to stop pivoting of said crank member beyond its lens closed locking position, said latch leg having a convex cam undersurface spaced from said frame by the thickness of said lens so as to be pivotable to a lens closed locking position overlying the rim of said lens and firmly pressing said lens closed against same frame in a sealing manner.

9. The apparatus of claim 8 in which said frame has an endless groove in said exposed face thereof and extending around said viewing area, an insect screen overlying said open viewing area and having a perimetral edge portion and a resilient seal ring pressed in said groove for locking said perimetral edge of said screen therein, said seal ring extending up out of said groove to seal against the rim of said lens with said lens in its closed locked position.

10. The apparatus of claim 7 in which said frame has a boss protruding from said exposed face of said frame and defining said pivot axis of said crank member.

11. A portlight for installation at an opening in a wall of a boat, comprising:

an interior frame surrounding an open viewing area, said interior frame comprising an axially exteriorly extending spigot for outward insertion in an opening in a wall of a boat and an interior flange extending radially outward from said spigot to overlap the interior face of the wall of the boat;

an exterior frame surrounding said open viewing area and overlapping the exterior face of the wall of the boat;

plural fastener means for fixedly clamping between said interior frame flange and exterior frame rim of the opening in the wall of the boat;

plural bosses extending exteriorly from said interior flange and integral with said interior frame and located at the radially outer side of said spigot for insertion part way through the opening in the wall of the boat, said plural fastener means comprising screws insertable through holes in said exterior frame into said opening in the wall of the boat and threadedly receivable in said plural bosses respectively for achieving said clamping of said rim of said opening in the wall of the boat between said interior frame and exterior frame, the exterior extent of said spigot and bosses being such that the exterior frame bears on said spigot and the exterior face of the boat wall but is axially spaced from the exterior ends of said bosses such that the interior and exterior frames can tightly grip the boat wall despite some variation in boat wall thickness.

12. The apparatus of claim 11 in which said interior frame includes in cross section a wedge-shaped bracing portion in the angle between the joinder of said spigot and interior flange, said bosses protruding from said bracing portion.

* * * * *

UNITED STATES PATENT AND TRADEMARK OFFICE

CERTIFICATE OF CORRECTION

PATENT NO. : 4 976 212

DATED : December 11, 1990

INVENTOR(S) : Richard J. Camarota

It is certified that error appears in the above-identified patent and that said Letters Patent is hereby corrected as shown below:

Column 8, line 32; delete "(Amended)".

Column 8, line 46; change "oposable" to ---opposable---.

Column 10, line 26; change "7" to ---8---.

Signed and Sealed this

Fifteenth Day of September, 1992

*Attest:*

DOUGLAS B. COMER

*Attesting Officer*

*Acting Commissioner of Patents and Trademarks*